US010921019B2

(12) United States Patent
Nakaya et al.

(10) Patent No.: US 10,921,019 B2
(45) Date of Patent: Feb. 16, 2021

(54) CEILING CONCEALED AIR-CONDITIONING APPARATUS

(71) Applicant: Mitsubishi Electric Corporation, Tokyo (JP)

(72) Inventors: Yoshie Nakaya, Tokyo (JP); Tetsuya Tazawa, Tokyo (JP); Keisuke Tomomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/474,451

(22) PCT Filed: Mar. 14, 2017

(86) PCT No.: PCT/JP2017/010234
§ 371 (c)(1),
(2) Date: Jun. 27, 2019

(87) PCT Pub. No.: WO2018/167848
PCT Pub. Date: Sep. 20, 2018

(65) Prior Publication Data

US 2020/0182510 A1 Jun. 11, 2020

(51) Int. Cl.
*F24F 13/20* (2006.01)
*F24F 1/0047* (2019.01)
*F24F 13/06* (2006.01)

(52) U.S. Cl.
CPC ..... *F24F 13/20* (2013.01); *F24F 1/0047* (2019.02); *F24F 13/06* (2013.01)

(58) Field of Classification Search
CPC ..... F24F 13/20; F24F 13/06; F24F 1/0047; F24F 13/32; F24F 13/084; F24F 1/0057
(Continued)

(56) References Cited

U.S. PATENT DOCUMENTS 6,220,562 B1 * 4/2001 Konkle ..... A47B 97/00 24/298
10,718,548 B1 * 7/2020 Hart ..... F24F 13/32
(Continued)

FOREIGN PATENT DOCUMENTS

EP 1327829 * 7/2003
EP 3 594 584 A1 1/2020
(Continued)

OTHER PUBLICATIONS

International Search Report of the International Searching Authority dated May 23, 2017 for the corresponding international application No. PCT/JP2017/010234 (and English translation).
(Continued)

*Primary Examiner* — Janet M Wilkens
(74) *Attorney, Agent, or Firm* — Posz Law Group, PLC

(57) ABSTRACT

A ceiling concealed air-conditioning apparatus includes: a box-shaped air-conditioning apparatus body having an open bottom; and an exterior panel attached to an underside of the air-conditioning apparatus body. The exterior panel includes: a panel body covering the open bottom of the air-conditioning apparatus body; and a panel unit removably attached to a lower part of the panel body. The panel body includes an opening at an area where the panel unit is attached to the panel body, and further includes a string hanger to hang a string at a corner of the opening, the string hanger being integral with the panel body and protruding to an inside of the opening. The panel unit includes a holding part to hold the string on a surface of the panel unit facing the panel body, the holding part being integral with the panel unit. One end of a loop of the string is held by the holding part and the other end of the loop of the string is hung on the string hanger to connect the panel body and the panel unit with the string.

7 Claims, 6 Drawing Sheets

(58) Field of Classification Search
USPC ..... 454/275; 312/236, 265.5, 265.6, 257.1, 312/263
See application file for complete search history.

(56) References Cited

U.S. PATENT DOCUMENTS

| | | | | |
|---|---|---|---|---|
| 2002/0189274 | A1* | 12/2002 | Lee | F24F 1/0011 62/298 |
| 2009/0077987 | A1* | 3/2009 | Egawa | F24F 13/082 62/259.1 |
| 2017/0191677 | A1* | 7/2017 | Jeong | F24F 11/89 |
| 2019/0346157 | A1* | 11/2019 | Komatsu | F24F 13/20 |
| 2019/0390871 | A1* | 12/2019 | Moro | F24F 13/20 |
| 2020/0096207 | A1* | 3/2020 | Kim | F24F 1/0018 |

FOREIGN PATENT DOCUMENTS

| | | | |
|---|---|---|---|
| JP | 09264563 | * | 10/1997 |
| JP | H10-227516 | A | 8/1998 |
| JP | 2001-108259 | A | 4/2001 |
| JP | 2001-263714 | A | 9/2001 |
| JP | 2004-239560 | A | 8/2004 |
| JP | 2015-137842 | A | 7/2015 |
| JP | 2017-009257 | A | 1/2017 |
| JP | 6056939 | * | 1/2017 |
| WO | 2005052456 | * | 6/2005 |
| WO | 2006038352 | * | 4/2006 |
| WO | 2007132752 | * | 11/2007 |
| WO | 2018146763 | * | 8/2018 |
| WO | 2018163285 | * | 9/2018 |
| WO | 2018179136 | * | 10/2018 |

OTHER PUBLICATIONS

Extended European Search Report dated May 13, 2020 for the corresponding EP application No. 17900338.9.
Examination Report dated Jul. 31, 2020 issued in corresponding IN patent application No. 201947035379.
Office Action dated Sep. 1, 2020 issued in corresponding JP patent application No. 2019-505565 (and English translation).

* cited by examiner

CEILING CONCEALED AIR-CONDITIONING APPARATUS

CROSS REFERENCE TO RELATED APPLICATION

This application is a U.S. national stage application of International Application No. PCT/JP2017/010234, filed on Mar. 14, 2017, the contents of which are incorporated herein by reference.

TECHNICAL FIELD

The present invention relates to ceiling concealed air-conditioning apparatuses, and more particularly, to a ceiling concealed air-conditioning apparatus including a structure to prevent a panel unit of an exterior panel from falling.

BACKGROUND

Existing ceiling concealed air-conditioning apparatuses include a box-shaped air-conditioning apparatus body having an open bottom and an exterior panel covering the open bottom of the air-conditioning apparatus body. The exterior panel includes a panel body and a suction grille having an air inlet, and the suction grille is attached to the panel body by an engagement mechanism. To remove the suction grille from the panel body for maintenance or other work, engagement by the engagement mechanism is released to enable removal of the suction grille from the panel body. During this work, the suction grille may slip through hands of a worker to fall down. One of methods used so far to prevent this is to connect the suction grille and the panel body with a string (e.g., see Patent Literature 1).

Patent Literature 1 discloses attaching mounting brackets to respective ends of the string and hooking one of the mounting brackets on a holding part on the panel body and the other on a holding part on the suction grille to thereby connect the suction grille and the panel body with the string.

PATENT LITERATURE

Patent Literature 1: Japanese Unexamined Patent Application Publication No. 2001-108259

The air-conditioning apparatus of Patent Literature 1 requires two components besides the string, and such an increase in components leads to increased cost. Also, the string needs to be tied around the mounting bracket for their connection, and this work needs to be done for each of the two mounting brackets, which increases assembly man-hours.

SUMMARY

The prevent invention has been made to address the above problems, and aims at providing a ceiling concealed air-conditioning apparatus that allows the number of components and assembly man-hours required to ensure that the panel unit attached to the panel body does not fall to be reduced.

According to an embodiment of the present invention, there is provided a ceiling concealed air-conditioning apparatus including: a box-shaped air-conditioning apparatus body having an open bottom; and an exterior panel attached to an underside of the air-conditioning apparatus body, wherein the exterior panel includes a panel body covering the open bottom of the air-conditioning apparatus body; and a panel unit removably attached to an underside of the panel body, the panel body includes an opening at an area where the panel unit is attached to the panel body, and further includes a string hanger to hang a string at a corner of the opening, the string hanger being integral with the panel body and protruding to an inside of the opening, and the panel unit includes a holding part to hold the string on a surface of the panel unit facing the panel body, the holding part being integral with the panel unit, one end of a loop of the string being held by the holding part and an other end of the loop of the string being hung on the string hanger to connect the panel body and the panel unit with the string.

According to an embodiment of the present invention, the panel unit and the panel body can be connected with the string just by hanging the string, which is held by the holding part integral with the panel unit, on the string hanger integral with the panel body. This means that it is only required to attach the string to the part integral with the panel body and the part integral with the panel unit. This eliminates the need for attaching beforehand an additional component to the string to enable its attachment to the panel body or the panel unit as well as the need for the component itself, allowing the number of components and assembly man-hours to be reduced.

DETAILED DESCRIPTION

Embodiment

Figure 1:
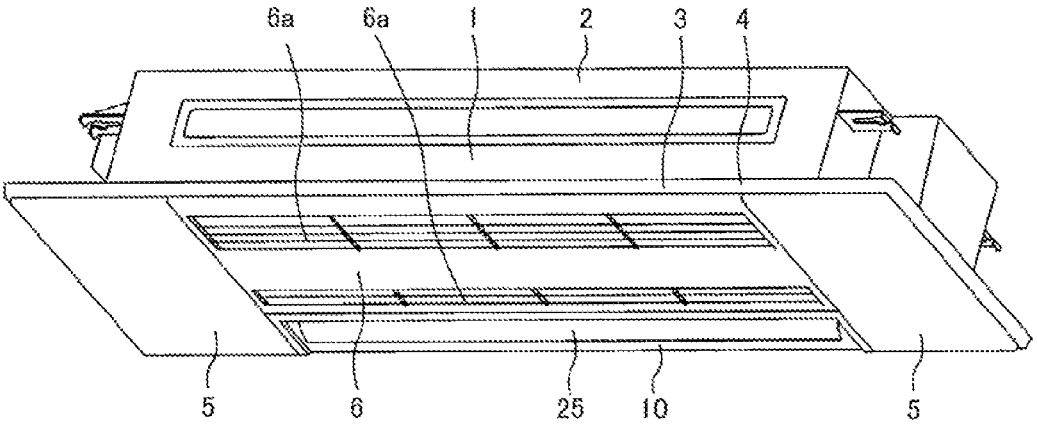
FIG. 1 is a perspective view of a ceiling concealed air-conditioning apparatus 1 according to an embodiment of the present invention.
Figure 2:
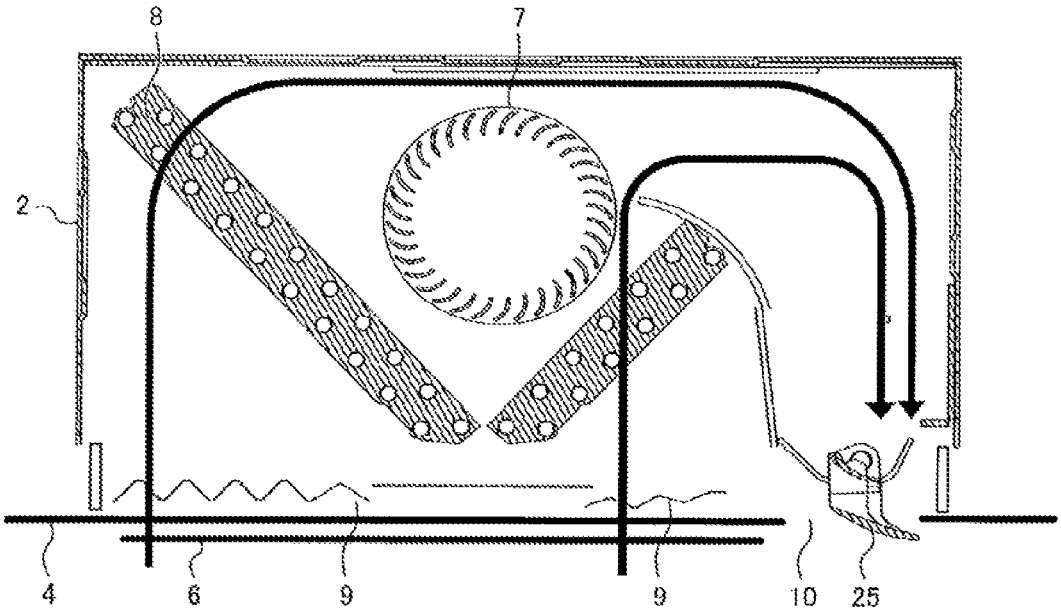
FIG. 2 is a schematic cross-sectional view of the ceiling concealed air-conditioning apparatus 1 according to the embodiment of the present invention.
Figure 3:
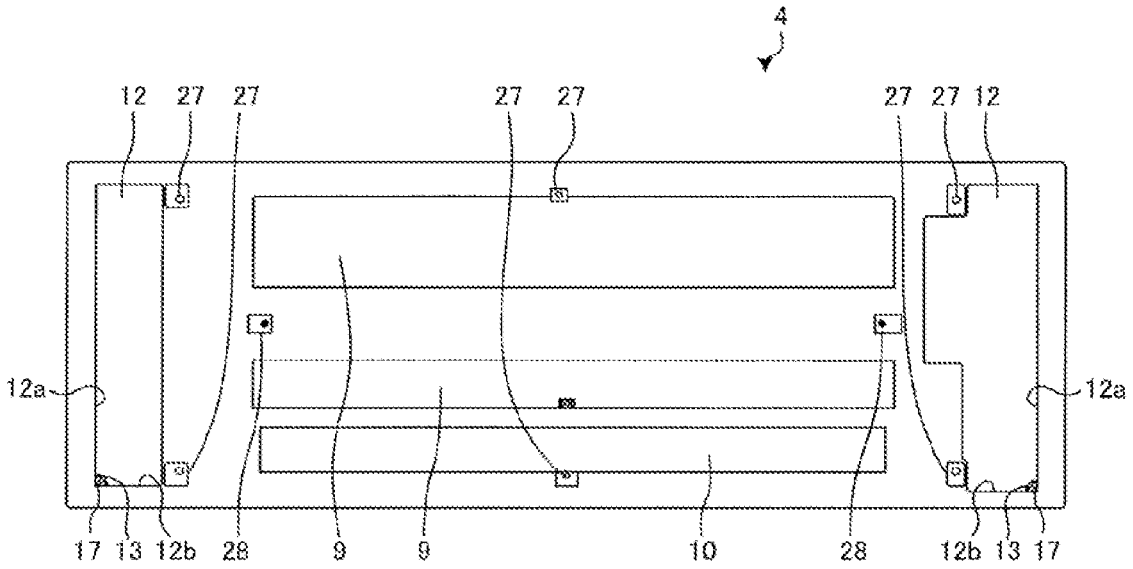
FIG. 3 illustrates a panel body 4 of the ceiling concealed air-conditioning apparatus 1 as viewed from the exterior according to the embodiment of the present invention.

FIG. 1 is a perspective view of a ceiling concealed air-conditioning apparatus 1 according to an embodiment of the present invention. FIG. 2 is a schematic cross-sectional view of the ceiling concealed air-conditioning apparatus 1 according to the embodiment of the present invention. FIG. 3 illustrates a panel body 4 of the ceiling concealed air-conditioning apparatus 1 as viewed from the exterior according to the embodiment of the present invention. In the following description, the terms like "up", "down", "left", "right", "front", "back", and "near" refer to directions relative to the ceiling concealed air-conditioning apparatus 1 when it is installed as shown in FIG. 1, except otherwise stated.

The ceiling concealed air-conditioning apparatus 1 is a cassette-type, concealed air-conditioning apparatus that includes an air-conditioning apparatus body 2 extending in one direction and having an open bottom, and an exterior panel 3 attached to a lower part of the air-conditioning apparatus body 2. The exterior panel 3 includes a rectangular panel body 4, side panels 5, and a suction grille 6.

The panel body 4 extends in a longitudinal direction of the air-conditioning apparatus body 2 and covers the open bottom of the air-conditioning apparatus body 2. As shown in FIG. 3, the panel body 4 is screwed to the air-conditioning apparatus body 2 at seven panel body screwing parts 27 on the panel body 4. At the center in the longitudinal direction, the panel body 4 includes two air inlets 9 and an air outlet 10 extending in the longitudinal direction of the panel body 4 and parallel to each other in a transverse direction of the panel body 4. The two air inlets 9 are adjacent to each other in the transverse direction. The number of air inlets 9 is not limited to two and may be any optional number. The air outlet 10 is provided with a vane 25 to adjust a direction of air blown into a room. The air outlet 10 corresponds to the first air outlet of the present invention.

The panel body 4 includes two openings 12 for working at respective ends in the longitudinal direction. Both of the openings 12 are substantially rectangular. At one internal corner 17 of each opening 12, there is a string hanger 13 to hang a string 19. The string hanger 13 will be described in detail later. Function of the opening 12 as a working opening will also be described in detail later.

The side panels 5 are removably attached to the respective ends of the panel body 4 in the longitudinal direction to cover the openings 12 of the panel body 4. Each of the side panels 5 corresponds to the panel unit of the present invention.

Figure 4:
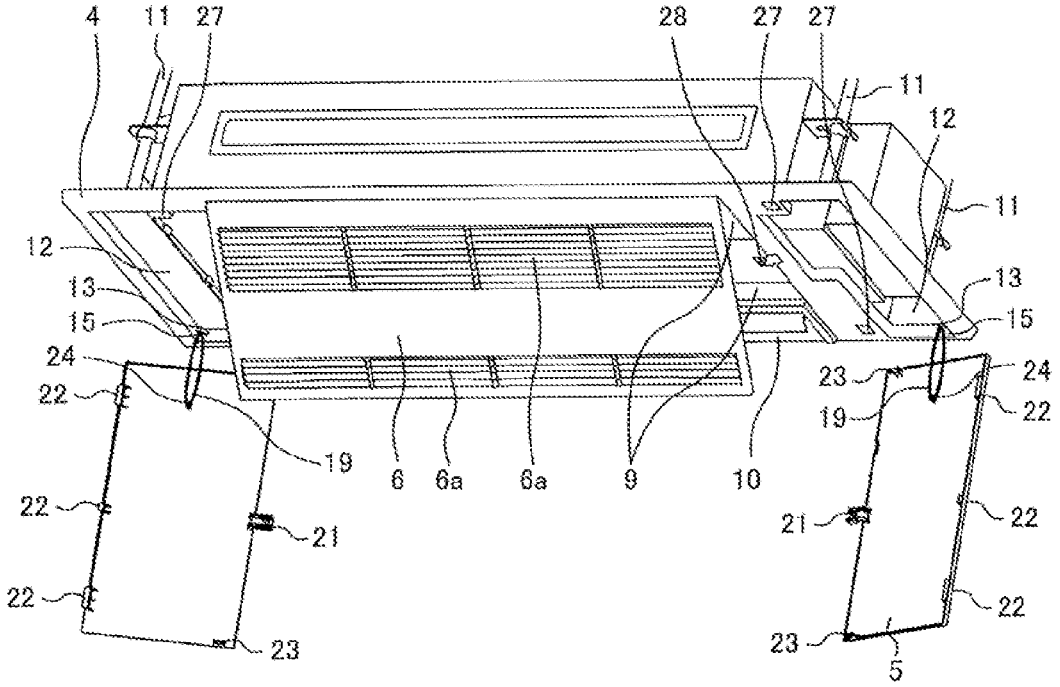
FIG. 4 is a perspective view of the ceiling concealed air-conditioning apparatus 1 according to the embodiment of the present invention when side panels 5 are removed and suspended from the panel body 4 each with a string 19.

The suction grille 6 is positioned at the center in the in the longitudinal direction of the panel body 4 and is made closer to one side in the transverse direction of the panel body 4, so that the suction grille 6 covers the air inlets 9 of the panel body 4. The suction grille 6 includes two grille air inlets 6*a* facing the two air inlets 9 of the panel body 4. As shown in FIG. 4 given below, the suction grille 6 is connected to the panel body 4 such that the suction grille 6 is pivotable on the panel body 4 through a shaft (not shown) laid along one side of the suction grille 6 in the longitudinal direction. This enables the suction grille 6 to open and close the air inlets 9. The other side of the grill opposite to the one side along which the shaft is laid is engaged to the panel body 4 by an engagement mechanism, whereby the suction grille 6 is attached to the panel body 4.

As shown in FIG. 2, an air flow path from the air inlets 9 to the air outlet 10 is formed inside the air-conditioning apparatus body 2. Disposed along the air flow path is a line flow fan 7 and a heat exchanger 8. By rotation of the line flow fan 7, air is suctioned from the grille air inlets 6*a* of the suction grille 6 through the air inlets 9 into the air-conditioning apparatus body 2. The suctioned air then passes through the heat exchanger 8, where the suctioned air exchanges heat and has its temperature conditioned before being blown from the air outlet 10. At this time, the vane 25 may be operated to change the direction of the air blown from the air outlet 10. The above air flow is represented by arrows in FIG. 2.

The ceiling concealed air-conditioning apparatus 1 is a one-way ceiling concealed air-conditioning apparatus that blows temperature-conditioned air from one air outlet 10. The ceiling concealed air-conditioning apparatus 1 of this type is installed such that, of two sides being opposite to each other in the transverse direction of the air-conditioning apparatus body 2, a side opposite to the air outlet 10 is located closer to a wall and thus the air outlet 10 is located farther from the wall. In relation to FIG. 1, the air-conditioning apparatus body 2 is installed such that the side on the near side in FIG. 1 is located closer to the wall.

FIG. 4 is a perspective view of the ceiling concealed air-conditioning apparatus 1 according to the embodiment of the present invention when the side panels 5 are removed and suspended from the panel body 4 each with the string 19.

The air-conditioning apparatus body 2 is suspended from, and held by, four suspending bolts 11 extended from a beam (not shown) above the ceiling. The suspension length of the air-conditioning apparatus body 2, namely the position of the air-conditioning apparatus body 2 from the ceiling is adjusted through the openings 12. Specifically, for installation of the ceiling concealed air-conditioning apparatus 1, the air-conditioning apparatus body 2 is suspended and the panel body 4 is fixed to the air-conditioning apparatus body 2, and then fastening degree of the suspending bolts 11 are adjusted through the openings 12 for fine adjustment of the suspension length of the air-conditioning apparatus body 2. This means that the openings 12 each serve as a working space, and thus the openings 12 are formed at positions on the panel body 4 facing the locations (here, the suspending bolts 11) where work is performed for the air-conditioning apparatus body 2.

Figure 5:
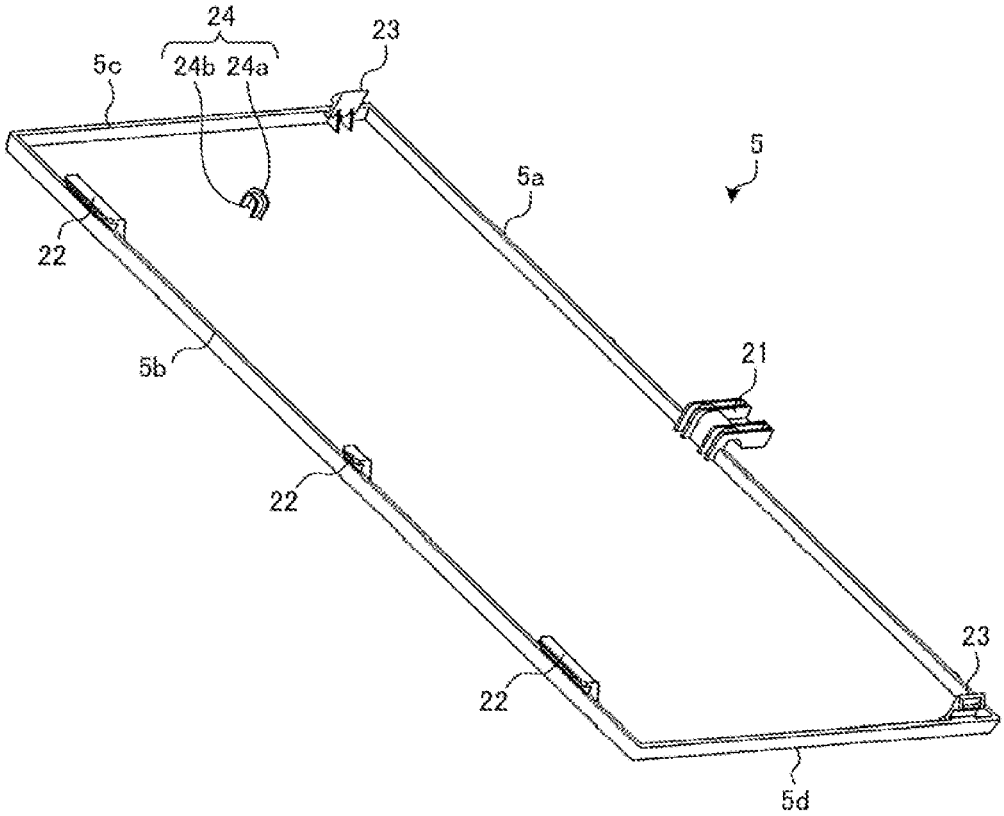
FIG. 5 is a perspective view of the side panel 5 of the ceiling concealed air-conditioning apparatus 1 according to the embodiment of the present invention, as viewed from the opposite side from an exterior surface of the side panel 5.

FIG. 5 is a perspective view of the side panel 5 of the ceiling concealed air-conditioning apparatus 1 according to the embodiment of the present invention, as viewed from the opposite side from an exterior surface of the side panel 5.

The side panel 5 is rectangular and extends in one direction. On four sides around the periphery of its surface (hereinafter, the "back surface") opposite to its exterior surface, the side panel 5 includes a flange 21 with a screw hole, three hook claws 22, and two fixing claws 23 spaced from each other. Specifically, the flange 21 is provided at the center of a side 5*a* that is closest to the air outlet 10 among the four sides. The three hook claws 22 are provided linearly at equal intervals on a side 5*b* opposite to the side 5*a*. The two fixing claws 23 are provided at positions close to the air outlet 10 on respective sides 5*c*, 5*d* perpendicular to the sides 5*a*, 5*b*. A holding part 24 holds the string 19 to suspend the side panel 5. The holding part 24 will be described in detail later.

For temporary fixing of the side panel 5 configured as mentioned above to the panel body 4, the hook claws 22 are hooked on the panel body 4 and the fixing claws 23 are engaged with engaging parts (not shown) of the panel body 4. Then, a screw is inserted from the screw hole of the flange 21 into a side panel screwing part 28 (see FIG. 3) on the panel body 4 to complete the fixing of the side panel 5 to the panel body 4.

A feature of the present embodiment lies in that the ceiling concealed air-conditioning apparatus 1 includes a panel unit anti-fall structure to prevent the side panel 5 from falling when it is removed. Below a description will be given of this structure.

Figure 6:
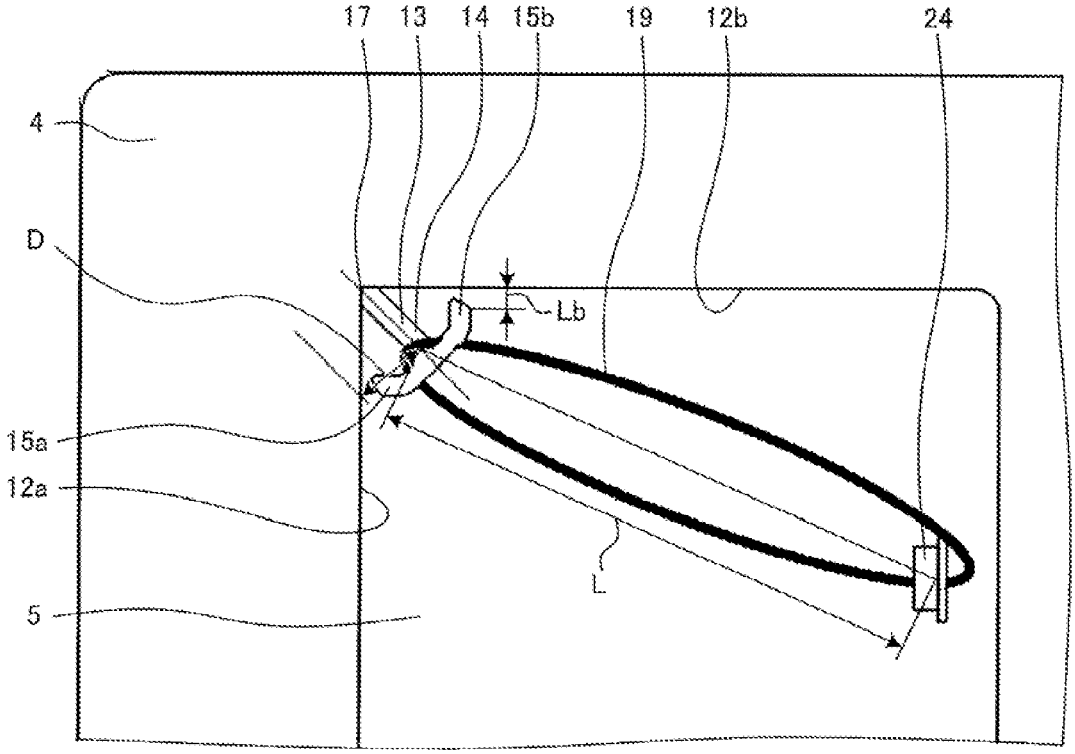
FIG. 6 is an explanatory diagram of a panel unit anti-fall structure of the ceiling concealed air-conditioning apparatus 1 according to the embodiment of the present invention.
Figure 7:
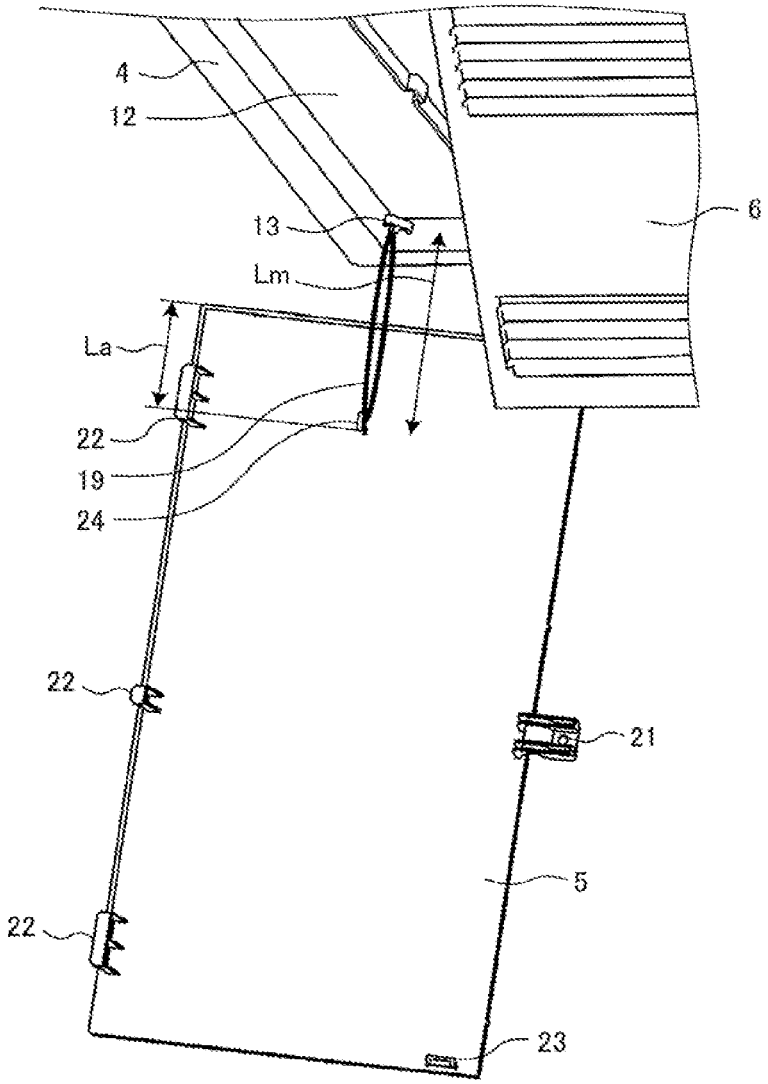
FIG. 7 is a perspective view illustrating the side panel 5 suspended from the ceiling concealed air-conditioning apparatus 1 according to the embodiment of the present invention.

FIG. 6 is an explanatory diagram of the panel unit anti-fall structure of the ceiling concealed air-conditioning apparatus 1 according to the embodiment of the present invention. FIG. 6 depicts how the string 19 is attached when the side panel 5 is attached to the panel body 4. For explanatory purposes, FIG. 6 also shows the holding part 24 on the side panel 5. FIG. 7 is a perspective view illustrating the side panel 5 suspended from the ceiling concealed air-conditioning apparatus 1 according to the embodiment of the present invention.

The panel unit anti-fall structure includes the string hanger 13 on the panel body 4 and the holding part 24 on the side panel 5. The string hanger 13 and the holding part 24 are connected with the string 19.

The string hanger 13 and the holding part 24 will be described in detail below one by one.

Figure 8:
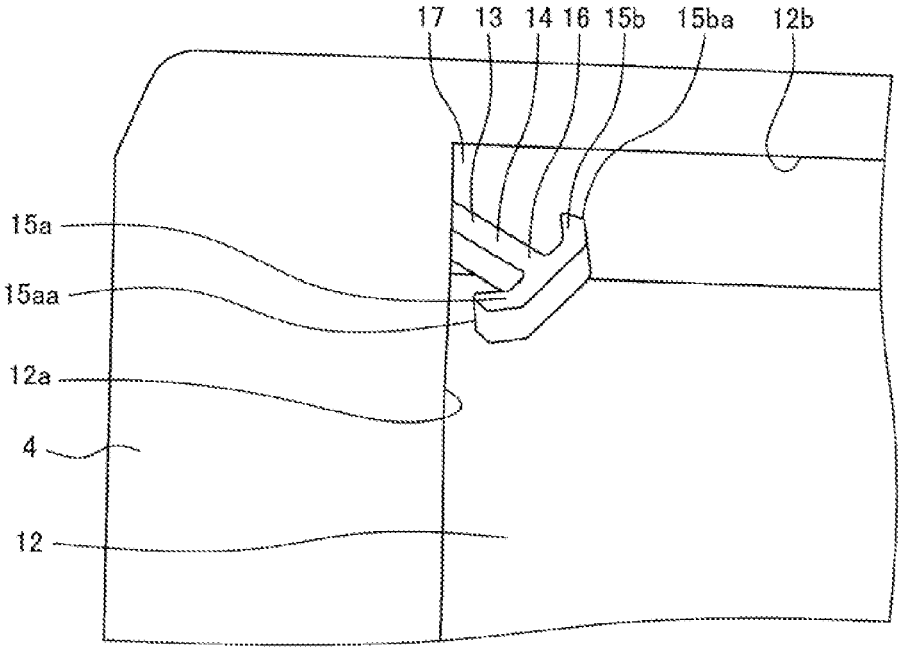
FIG. 8 is an enlarged perspective view of a string hanger 13 on the panel body 4 of the ceiling concealed air-conditioning apparatus 1 according to the embodiment of the present invention.

FIG. 8 is an enlarged perspective view of the string hanger 13 on the panel body 4 of the ceiling concealed air-conditioning apparatus 1 according to the embodiment of the present invention.

The string hanger 13 is provided at one corner 17 of the opening 12 as described above. The corner 17 for the string hanger 13 is between a face 12*a* and a face 12*b* of the opening 12 among its four inner faces. The face 12*a* is near and along a longitudinal end of the panel body 4. The face 12*b* is one of two faces of the opening 12 being opposite to each other in the transverse direction of the panel body 4 and is closer to the air outlet 10 than the other of the two faces being opposite to each other in the transverse direction.

As described above, the ceiling concealed air-conditioning apparatus 1 is a one-way air-conditioning apparatus, and its side opposite to that closer to the air outlet 10 in the transverse direction of the air-conditioning apparatus body 2 is located near the wall. Accordingly, the corner 17 is located at a position that is opposite from the wall, on which the air-conditioning apparatus body 2 is mounted, and also distant from the air flow path. With the string hanger 13 provided at the corner 17 in this position, the side panel 5 is prevented from swinging toward the air outlet 10 and hitting the wall when the side panel 5 is removed from the panel body 4 and suspended with the string 19. This prevents damage to the wall and the side panel 5.

The string hanger 13 consists of a first piece 14 protruding from the corner 17 to the inside of the opening 12, and a pair of second pieces 15*a*, 15*b* extending from a distal end of the first piece 14 to opposite directions and then bent backward. More specifically, the first piece 14 protrudes at 45 degrees relative to each of the two faces forming the corner 17. The pair of second pieces 15*a*, 15*b* extends from the distal end of the first piece 14 at right angles relative to the first piece 14 and then extend perpendicularly toward the faces 12*a*, 12*b*, to which distal end faces 15*aa*, 15*ba* of the second pieces 15*a*, 15*b* face, respectively. Both end faces 16 of the string hanger 13 in the up-down direction (the direction perpendicular to the plane of FIG. 8) are flat and parallel to the faces of the panel body 4 in the same direction.

By virtue of both end faces 16 of the string hanger 13 in the up-down direction (the direction perpendicular to the plane of FIG. 8) being flat and parallel to the faces of the panel body 4 in the same direction, the string hanger 13 and the panel body 4 can be formed integrally into a single part when the panel body 4 is molded. This can be done without any constraint on dies to be used. The pair of second pieces 15*a*, 15*b* extends at right angles relative to the first piece 14, but the angle of extension is not limited to right angles. Other than right angles, sharp angles are also preferable to facilitate the hanging of the string 19.

To hang the string 19 on the string hanger 13, the string 19 may be passed through gaps between the distal end face 15*aa* of the second piece 15*a* and the face 12*a* and between the distal end face 15*ba* of the second piece 15*b* and the face 12*b*.

Each distance Lb (see FIG. 6) between the distal end face 15*aa* of the second piece 15*a* and the opposing face 12*a* and between the distal end face 15*ba* of the second piece 15*b* and the opposing face 12*b* will now be discussed.

Given the nature of being hung on and removed from the string hanger 13, the string 19 preferably has a structure that not only enables easy hanging and removal of the string 19 by a worker but also prevents the string 19 from easily falling off the string hanger 13 once hung on the string hanger 13. For this reason, each distance Lb between the distal end face 15*aa* and the opposing face 12*a* and between the distal end face 15*ba* and the opposing face 12*b* is set as follows. That is, in view of the fact that the string 19 deforms to get thinner by being stretched, the distance Lb is set equal to or larger than the diameter of the string 19 under tension, and smaller than the diameter in natural state of the string 19. This ensures that the string 19 hardly falls off the second pieces 15*a*, 15*b* once hung on the string hanger 13, but can be easily removed intentionally by an installation worker. This reduces a burden on the worker.

A description will be now given of the holding part 24.

As shown in FIG. 5, the holding part 24 is integrally formed on the back surface of the side panel 5. The holding part 24 consists of a square protrusion 24*a* protruding perpendicularly from the back surface of the side panel 5, and a through hole 24*b* inside the protrusion 24*a*. The through hole 24*b* extends in a direction perpendicular to the side 5*b* provided with the hook claws 22.

To attach the string 19 to the panel unit anti-fall structure configured as above, the string 19 is first passed through the holding part 24 on the side panel 5, and then both ends of the string 19 are tied to form a loop. This results in a situation that one end of the looped string 19 being held by the holding part 24. The other end of the looped string 19 is then hung on the second pieces 15*a*, 15*b* of the string hanger 13 on the panel body 4. This completes attachment of the string 19.

The position of the holding part 24 on the side panel 5 will now be described. The position of the holding part 24 is defined by relationship between the shape of the string hanger 13 on the panel body 4 and the length of the string 19. Specifically, the position of the holding part 24 is defined such that the string 19 remains stretched when it is attached to the string hanger 13 and the holding part 24 and also the side panel 5 is attached to the panel body 4. This is because, if loosened, the string 19 may be caught in between the side panel 5 and the panel body 4, and besides, may be exposed from the side panel 5, which spoils the appearance of the ceiling concealed air-conditioning apparatus 1. Further, the position of the holding part 24 is defined such that, when suspended from the panel body 4, the side panel 5 is well spaced from the panel body 4 to avoid hitting the panel body 4.

The position satisfying the above conditions may satisfy the following relationship:

$$L<Lm<L+D$$

and $$Lm>La$$

where: L is a distance between the distal end of the first piece 14 of the string hanger 13 and the holding part 24;

D is a distance, in a direction perpendicular to the first piece 14, between the distal end of the first piece 14 of the string hanger 13 and the face 12*a*, which is one of the two faces to form the corner 17 for the string hanger 13 and faces the distal end of the second piece 15*a;*

Lm is a length of the loop of the string 19; and

La is a length of overlap between the side panel 5 and the string 19 in the up-down direction when the side panel 5 is suspended.

Providing the holding part 24 at the position satisfying the above relationship can ensure that the string 19 does not get loose while the side panel 5 is attached to the panel body 4, and that the side panel 5 does not hit the suction grille 6 when suspended from the panel body 4.

A description will now be given of how installation work is performed.

The exterior panel 3 is moved to an installation site after the string 19 as well as the suction grille 6 and the side panels 5 are attached to the panel body 4. When installing the ceiling concealed air-conditioning apparatus 1, a worker first fixes the exterior panel 3 to the air-conditioning apparatus body 2 suspended from above the ceiling.

Each side panel 5 is then removed from the panel body 4. To remove the side panel 5, the suction grille 6 is opened to expose the flange 21. Then, a screw in the flange 21 is removed and the two fixing claws 23 on the side panel 5 are disengaged. Finally, the three hook claws 22 on the side panel 5 are disengaged. This enables removal of the side panel 5 from the panel body 4.

If the worker loses his/her hold of the side panel 5 after completely removing it from the panel body 4, the side panel 5 can remain suspended from the string hanger 13 with the string 19. This prevents the side panel 5 from falling and being lost.

Also, the worker can perform the installation work with the left and right side panels 5 being suspended from the panel body 4 with the respective strings 19. Accordingly, the side panels 5 can be reattached to the panel body 4 just by being pulled up from the suspended position. This enables quicker reattachment of the side panels 5 than temporarily placing the removed side panels 5 on the floor before reattaching them, and this makes the installation and maintenance work more convenient.

As described above, according to the present embodiment, each side panel 5 and the panel body 4 can be connected with the string 19 just by hanging the string 19, which is held by the holding part 24 integral with the side panel 5, on the string hanger 13 integral with the panel body 4. This means that the worker is only required to attach the string 19 to the integral part of the panel body 4 and the integral part of the side panel 5. This eliminates the need for attaching beforehand an additional component to the string 19 to enable its attachment as well as the need for the component itself, allowing the number of components and assembly man-hours to be reduced.

The string hanger 13 consists of the first piece 14 protruding from the corner 17 of the opening 12 to the inside of the opening 12, and the pair of second pieces 15*a*, 15*b* extending from the distal end of the first piece 14 to opposite directions and then bent back. This bent structure of the second pieces 15*a*, 15*b* not only ensures that the string 19 hardly falls off once attached, but also enables easy removal of the string 19. This makes the assembly and installation work more convenient.

Further, the distance between each of the distal ends of the bent second pieces 15*a*, 15*b* and a corresponding one of the faces forming the corner 17 is set equal to or larger than the diameter of the string 19 under tension, and smaller than the natural diameter of the string 19. This not only enables easy hanging of the string 19 on the string hanger 13, but also ensures that the string 19 hardly falls off the string hanger 13 by accident.

Positioning the holding part 24 at the position on the side panel 5 satisfying the relationship of L<Lm<L+D, and Lm>La ensures that the string 19 remains stretched while the side panel 5 is attached to the panel body 4. This helps to avoid unwanted situations, such as the string 19 being caught in between the panel body 4 and the side panel 5 and the side panel 5 hitting the panel body 4 when suspended from the panel body 4.

Among the multiple corners of the opening 12, the string hanger 13 is provided at the corner 17 that is opposite to the wall, on which the air-conditioning apparatus body 2 is mounted, and also distant from the air flow path. The side panel 5 thus does not hit the wall when suspended from the panel body 4, and this prevents damage to the wall and the side panel 5.

The opening 12 is formed to face the location where work is performed for the air-conditioning apparatus body 2; in other words, the opening 12 is not an area exclusively for the string hanger 13. This means that no design changes other than adding the string hanger 13 are required to provide the string hanger 13 on the panel body 4. Moreover, the string hanger 13 can be provided utilizing a kind of vacant space in the panel body 4.

The string hanger 13 is located at the corner 17 of the opening 12, which is a position the worker usually does not touch during his or her work through the opening 12. This prevents not only damage to the string hanger 13 but also injuries of the hands of the worker.

The ceiling concealed air-conditioning apparatus 1 of the present invention is not limited to that shown in the above figures, and may be modified within the scope of the present invention in various ways, examples of which are given below.

(Modification 1)

Figure 9:
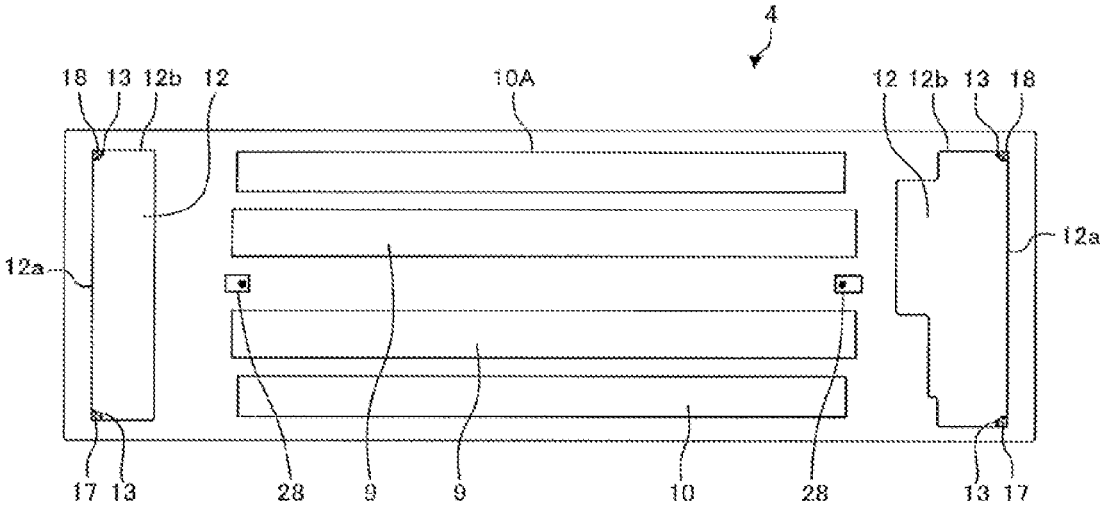
FIG. 9 illustrates a two-way panel body 4 of the ceiling concealed air-conditioning apparatus 1 as viewed from the exterior according to the embodiment of the present invention.

The above ceiling concealed air-conditioning apparatus 1 is a one-way air-conditioning apparatus having one air outlet 10, but the ceiling concealed air-conditioning apparatus 1 may be a two-way air-conditioning apparatus having two air outlets 10. Referring to FIG. 9 given below, a description will be given of the position of the string hanger 13 of such a two-way air-conditioning apparatus.

FIG. 9 illustrates a two-way panel body 4 of the ceiling concealed air-conditioning apparatus 1 as viewed from the exterior according to the embodiment of the present invention.

The two-way panel body 4 includes another air outlet 10A besides the air outlet 10 of the embodiment shown in FIG. 3. Specifically, the panel body 4 includes the air outlets 10, 10A at respective ends in the transverse direction of the panel body 4 and at the center in the longitudinal direction thereof, and two air inlets 9 are formed between the two air outlets 10, 10A. The air outlet 10A corresponds to the second air outlet of the present invention.

As described above, the one-way ceiling concealed air-conditioning apparatus 1 is installed such that, of two sides being opposite to each other in the transverse direction of the air-conditioning apparatus body 2, a side opposite to the other near the air outlet 10 is located closer to the wall. The two-way ceiling concealed air-conditioning apparatus 1, however, has the two air outlets 10, 10A, and thus it is not decided which one of the two sides being opposite to each other in the transverse direction of the air-conditioning apparatus body 2 is located closer to the wall. Also, depending on the installation environment, both of the two sides being opposite to each other in the transverse direction of the air-conditioning apparatus body 2 may be located away from the wall. For this reason, the two-way ceiling concealed air-conditioning apparatus 1 includes string hangers 13 at multiple corners 17, 18 of each opening 12 that are located farther from the air flow path in the longitudinal direction than the other corners of the opening 12. This allows the position at which the side panel 5 is to be suspended to be selected according to the installation environment of the ceiling concealed air-conditioning apparatus 1.

When the multiple string hangers 13 are provided at the opening 12 in this way, as many holding parts 24 are provided on the side panel 5. Each holding part 24 is of course positioned to satisfy the relationship of $L<Lm<L+D$, and $Lm>La$, in relation to the corresponding string hanger 13.

(Modification 2)

Figure 10:
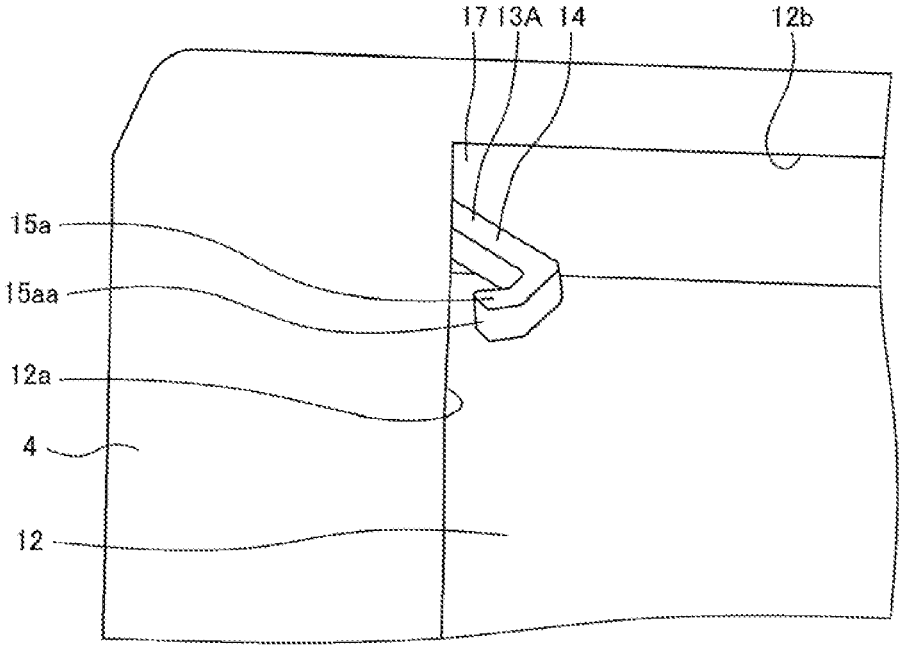
FIG. 10 is an enlarged perspective view of a modification of the string hanger 13 of the ceiling concealed air-conditioning apparatus 1 according to the embodiment of the present invention.

FIG. 10 is an enlarged perspective view of a modification of the string hanger 13 of the ceiling concealed air-conditioning apparatus 1 according to the embodiment of the present invention.

The string hanger 13 shown in FIG. 6 includes the two second pieces 15*a*, 15*b* at the distal end of the first piece 14. In contrast, a string hanger 13A of the modification shown in FIG. 10 includes one second piece 15*a*. The other structure and the position of the string hanger 13A are the same as the string hanger 13. The string hanger 13A of this configuration can provide the same effects as described above.

The present embodiment has discussed the side panel 5 as a panel unit to be suspended. The present invention is, however, applicable to the suction grille 6 besides the side panel 5.

The opening 12 discussed herein is rectangular, but the shape of the opening 12 is not limited to this. Also, the opening 12 has been described as providing a working space, but the opening 12 to be provided with the string hanger 13 is not necessarily one that serves as a working space. The above string hanger 13 is at the corner of the opening 12, but the location for the string hanger 13 is not limited to the corner of the opening 12. That is, the string hanger 13 is only required to be provided on the inner periphery of the opening 12. Nonetheless, when the opening 12 is used as a working space, the location for the string hanger 13 is preferably the corner of the opening 12 in that the worker usually does not touch the corner as described above.

REFERENCE SIGNS LIST

1 Ceiling concealed air-conditioning apparatus 2 Air-conditioning apparatus body 3 Exterior panel 4 Panel body 5 Side panel 5*a* Side 5*b* Side 5*c* Side 5*d* Side 6 Suction grille 6*a* Grille air inlet 7 Line flow fan 8 Heat exchanger 9 Air inlet 10 Air outlet 10A Air outlet 11 Suspending bolt 12 Opening 12*a* Face 12*b* Face 13 String hanger 13A String hanger 14 First piece 15*a* Second piece 15*aa* Distal end face 15*b* Second piece 15*ba* Distal end face 16 End face 17 Corner 19 String 21 Flange 22 Hook claw 23 Fixing claw 24 Holding part 24*a* Protrusion 24*b* Through hole 25 Vane 27 Panel body screwing part 28 Side panel screwing part

The invention claimed is:

1. A ceiling concealed air-conditioning apparatus comprising:

a box-shaped air-conditioning apparatus body having an open bottom; and an exterior panel attached to a lower part of the air-conditioning apparatus body, wherein the exterior panel comprises a panel body covering the open bottom of the air-conditioning apparatus body; and a panel unit removably attached to a lower part of the panel body, the panel body includes an opening at an area where the panel unit is attached to the panel body, and further includes a string hanger to hang a string at a corner of the opening, the string hanger being integral with the panel body and protruding to an inside of the opening, and the panel unit includes a holding part to hold the string on a surface of the panel unit facing the panel body, the holding part being integral with the panel unit, one end of a loop of the string being held by the holding part and an other end of the loop of the string being hung on the string hanger to connect the panel body and the panel unit with the string, and the opening is provided so as to face a working space of the air-conditioning apparatus body, wherein a distance between a distal end of the string hanger and a face of the opening is larger than a diameter of the string under tension and smaller than a natural diameter of the string.

2. The ceiling concealed air-conditioning apparatus of claim 1, wherein the string hanger comprises a first piece and a pair of second pieces, the first piece protruding from the corner of the opening to the inside of the opening, the pair of second pieces extending from a distal end of the first piece in opposite directions and then bent back.

3. The ceiling concealed air-conditioning apparatus of claim 1, wherein the string hanger comprises a first piece and a second piece, the first piece protruding from the corner of the opening, the second piece being bent back from a distal end of the first piece.

4. A ceiling concealed air-conditioning apparatus comprising:

a box-shaped air-conditioning apparatus body having an open bottom; and an exterior panel attached to a lower part of the air-conditioning apparatus body, wherein the exterior panel comprises a panel body covering the open bottom of the air-conditioning apparatus body; and a panel unit removably attached to a lower part of the panel body, the panel body includes an opening at an area where the panel unit is attached to the panel body, and further includes a string hanger to hang a string at a corner of the opening, the string hanger being integral with the panel body and protruding to an inside of the opening, and the panel unit includes a holding part to hold the string on a surface of the panel unit facing the panel body, the holding part being integral with the panel unit, one end of a loop of the string being held by the holding part and an other end of the loop of the string being hung on the string hanger to connect the panel body and the panel unit with the string, the panel body extends in a longitudinal direction of the air-conditioning apparatus body, the panel body includes an air inlet and a first air outlet at a center in a longitudinal direction of the panel body, the air inlet and the first air outlet extending in the longitudinal direction of the panel body and parallel to each other in a transverse direction of the panel body, and the opening comprises two openings at respective longitudinal ends of the panel body.

5. The ceiling concealed air-conditioning apparatus of claim 4, wherein each of the two openings is rectangular, and in each of the two openings, the string hanger is positioned at a corner formed by two faces of the opening among four inner faces thereof, one of the two faces being a face near and along a corresponding one of the longitudinal ends of the panel body, an other of the two faces being one of two faces being opposite to each other in the transverse direction of the panel body and closer to the first air outlet than an other of the two faces being opposite to each other in the transverse direction.

6. The ceiling concealed air-conditioning apparatus of claim 5, wherein the panel body includes a second air outlet located such that the air inlet is interposed between the first air outlet and the second air outlet in the transverse direction of the panel body, and the string hanger comprises two string hangers, and, among the four inner faces of the opening, the string hangers are positioned at respective ends of the face near and along the corresponding one of the longitudinal ends of the panel body.

7. A ceiling concealed air-conditioning apparatus comprising:

a box-shaped air-conditioning apparatus body having an open bottom and extending in one direction; and an exterior panel attached to a lower part of the air-conditioning apparatus body, wherein the exterior panel comprises a panel body covering the open bottom of the air-conditioning apparatus body; and a panel unit removably attached to a lower part of the panel body, the panel body includes an opening at an area where the panel unit is attached to the panel body, and further includes a string hanger to hang a string at a corner of the opening, the string hanger being integral with the panel body and protruding to an inside of the opening, and the panel unit includes a holding part to hold the string on a surface of the panel unit facing the panel body, the holding part being integral with the panel unit, one end of a loop of the string being held by the holding part and an other end of the loop of the string being hung on the string hanger to connect the panel body and the panel unit with the string, wherein the string hanger comprises a first piece and a second piece, the first piece protruding from the corner of the opening, the second piece being bent back from a distal end of the first piece, wherein the holding part is positioned on the panel unit at a position satisfying a following relationship:

$$L<Lm<L+D$$

and $$Lm>La$$

where: L is a distance between the distal end of the first piece of the string hanger and the holding part;

D is a distance, in a direction perpendicular to the first piece, between the distal end of the first piece of the string hanger and a face of the opening that is one of two faces of the opening to form the corner for the string hanger and faces the distal end of the second piece;

Lm is a length of the loop of the string; and

La is a length of overlap between the panel unit and the string in an up-down direction when the panel unit is suspended, wherein a distance between a distal end of the second piece of the string hanger and a face of the opening that is one of two faces of the opening to form the corner and faces the distal end of the second piece is set larger than a diameter of the string under tension and smaller than a natural diameter of the string.

* * * * *